United States Patent [19]

Benjamin

[11] 4,396,137

[45] Aug. 2, 1983

[54] CAMERA BODY HARNESS

[76] Inventor: Christie D. Benjamin, 2070 Stockbridge Ave., Redwood City, Calif. 94061

[21] Appl. No.: 273,391

[22] Filed: Jun. 15, 1981

[51] Int. Cl.[3] ..... A45F 5/00

[52] U.S. Cl. ..... 224/257; 224/255; 224/908

[58] Field of Search ..... 224/255, 257, 908; 24/252 R, 253, 254

[56] References Cited

U.S. PATENT DOCUMENTS

| | | | |
|---|---|---|---|
| 1,521,903 | 1/1925 | Mueller | 24/252 R |
| 2,130,262 | 9/1938 | Burlin | 224/255 |
| 3,305,148 | 2/1967 | Zimmerman | 224/257 |

*Primary Examiner*—Steven M. Pollard

*Attorney, Agent, or Firm*—C. Michael Zimmerman

[57] ABSTRACT

A harness for snuggly securing a camera against the torso of a human body includes a quick release fastening means assembled from two members that are releasably engaged securely with each other and operable with a single hand for releasing such engagement. One of the two members of the quick release fastening means is secured to a belt which encircles the torso for restraining that member thereto. The other of the two members is adapted to be secured to the camera. Engagement of the members of the quick release fastening means, when the members are respectively secured to the camera and to the human body, secures the camera against the torso. The harness further includes an elongated neck-strap worn around the neck of the camera user, which is adapted for attachment to the camera so that the camera is supported at a location where it may be secured against the torso by the cooperating quick release fastening means and belt.

8 Claims, 5 Drawing Figures

CAMERA BODY HARNESS

BACKGROUND OF THE INVENTION

1. Field of the Invention

This invention relates generally to a harness for securing an article to a human body and more particularly to a harness particularly suited for securing a camera against the torso of a human body while the camera is suspended from the user's neck by a neckstrap.

2. Description of the Prior Art

Various small articles such as binoculars, sound equipment, musical instruments, breathing apparatus and, in particular, cameras are frequently provided with a neckstrap so they may be suspended from the user's neck. Thus suspended, they are generally supported at the chest area of the human torso in pendulum fashion. Supported in this manner, the articles are easily and quickly moved about as desired or needed for use. However, an article suspended from the neck in pendulum fashion is free to swing as its wearer moves. In many circumstances, such swinging is a nuisance. In many activities, however, such as running, this swinging may be severely annoying while in other activities, such as rock climbing, it may be life threatening. Thus, it has been found advantageous to fix such articles more securely to the human body during such activities.

An example of an approach to securing such articles to the torso of a human body is described in German Pat. No. 245405. The apparatus described in the German patent employs a first elastic belt passing about the human torso immediately above the waist. Secured at both ends of this elastic belt are rings which respectively surround opposite, parallel portions of a binocular's neckstrap. A second elastic belt threaded about the binocular is connected respectively at its ends to these same rings. Thus engaged, the binocular is urged toward the chest of the user by the elastic bands when supported only by the neckstrap but may be raised to eye level for use by stretching the elastic bands. A first problem with this apparatus is that the elastic bands do not secure the binocular snuggly to the human body. The binocular cannot be secured snuggly by this apparatus because the elastic bands are in their lowest tension position when the suspended binocular hangs in pendulum fashion from the user's neck and may be constructed with only limited strength if the binocular is to be easily raised for use. Thus, the apparatus can serve only to diminish, rather than supress, swinging of the binocular. A second difficulty with this apparatus is that during the binocular's use the user must support it against the combined forces of both the binocular's weight and the tension of the elastic bands.

Another approach to securing such articles to the torso of the human body is described in U.S. Pat. No. 3,305,148. The apparatus described in that patent employs a first, non-elastic belt surrounding the torso above the waist. Each of one or more second, much smaller belts, equal in number to the number of articles being secured, is supported from and along the length of the first belt by an encircling loop formed in an end of the smaller belt. The loop of each smaller belt is formed with a projecting end at which is located one of the two connecting members of a snap type fastener. The other mating connecting member of this snap fastener is attached to one end of a strap, the other end of which is adapted for attachment to the article being secured. As with the apparatus disclosed in the aforementioned German patent, the apparatus of U.S. Pat. No. 3,305,148 serves only to diminish, rather than supress swinging of the secured article. Further, because of the difficulty of disengaging suitably strong snap type fasteners, two hands must be employed to free the article from its secured position prior to use. During certain types of activities, particularly rock climbing, it may be impossible to simultaneously free two hands for this purpose.

Other examples of apparatus for securing articles against the torso of the human body are described in U.S. Pat. Nos. 3,884,403 and 4,033,488. The basic apparatus taught in both these patents includes a single belt, the central portion of which is positioned horizontally across the chest below the level of the arm pits. The respective side portions of this belt are then guided along a path immediately beneath the arms and diagonally upward across the back of the wearer to pass over the opposite shoulder thus forming the letter "X" across the middle of the wearer's back. The respective ends of this belt extend downward from the shoulder onto the chest of the wearer. These patents further teach a variety of devices for securing articles between the central portion of the belt and its ends located at the chest immediately thereabove. The principal problem with such apparatus is that the belt's tortuous path about the torso makes it difficult to put on, uncomfortable to wear and/or unsuitable for use by women.

SUMMARY OF THE INVENTION

Briefly, the present invention is a quick release fastening means and an improved harness employing the same for securing an article, such as a photographic camera, to a human torso. The quick release fastening means of this invention includes a pair of engageable members, namely, an attaching member and an attached member, adapted for secure engagement with each other. One of these engageable members is further joined to a means for securing such engageable member in place relative to a human torso. Although a multiplicity of different types of means for so securing such engageable member are possible, the preferred embodiment of this invention employs a belt to which such engageable member is joined. The belt is worn by the user about the upper portion of the torso, in the region of the waist, preferably positioned at or immediately below the level of the article being secured. For this reason, a suspension is provided that cooperates with the harness for positioning the article at this location, while simultaneously supporting its weight. The second of the engageable members of the quick release fastening means is adapted to be secured to the article so supported. Thus, the article can be snuggly secured to the human torso by engaging the attaching member and the attached member of the quick release fastening means after one of these members has been secured to the human torso and the other of these members has been secured to the article. The combination of supporting means for the article and quick release fastening means secured to the torso by the circumtorso belt provides a comfortable harness for securing the article about the upper portion of the human torso. Moreover, the belt to which the quick release fastening means is joined defines a pair of longitudinally opposed ends which are joined at separate locations of the quick release fastening means. This joining of the belt and quick release fastening means lends stability to the securing of the article against the human torso.

In addition to being engageable with the attached member of the quick release fastening means, the attaching member thereof, in accordance with an objective of this invention, is operable with only a single hand for releasing the attached member from engagement. In a preferred embodiment, the attaching member includes two dish-shaped clamping plates positioned in opposition to each other. These clamping plates retain a coil spring under compression between their respective facing side surfaces. Thus compressed, the coil spring applies a force to the clamping plates urging them away from each other. These plates also include mating hinge leaves projecting from their respective adjacent edges. A cylindrically-shaped hinge pin passing through and secured within these leaves pivotably secures them to each other. The plates further include a pair of separable aperture forming elements secured to adjacent edges of the respective clamping plates opposite to the hinge leaves. These separable aperture forming elements are formed in the shape of mating, intermeshing curved hooks projecting from the respective edges of the clamping plates. The ends of these curved hooks farthest from the edges of the clamping plates are shaped to contact and mate with each other. When mated and contacting, the curved hooks form an openable, cylindrically-shaped aperture aligned essentially parallel to the hinge pin. Thus assembled, the clamping plates are restrained from further separating in response to the force applied by the retained, compressed coil spring by the hinge leaves as secured together by the hinge pin and by the mating end surfaces of the aperture forming elements. Further, the cylindrically shaped aperture formed by the mating aperture forming elements is opened at the ends of the curved hooks by pressing the clamping plates toward each other in opposition to the coil spring's separating force. As is readily apparent, such an opening force may be applied by merely squeezing the clamping plates of the attaching member between the thumb and fingers of a single human hand or by squeezing the clamping plates between the palm of a hand and the torso of the user. As should also be apparent, this embodiment of the attaching member of the quick release fastening means may be simply and economically fabricated by stamping the clamping plates thereof from sheet metal.

The attached member of the quick release fastening means of this invention is especially adapted, in its preferred embodiment, for use with photographic film cameras. More specifically, the attached member includes a stud adapted at one end to mate with a connector receptacle such as is usually found in film cameras. This attached member also includes a locking means which is employed to bind the mated stud and camera together. Further, the attached member includes a clamping ring securely fastened at a second end of the stud. This clamping ring is inserted within the openable aperture formed by the mating curved hooks of the attaching member to secure the attached member to the attaching member. Thus, a camera secured to the attached member and supported about the upper portion of a human torso is secured snuggly in place by the engaging clamping ring and mating curved hooks of the attaching member. Further, a camera so secured may be released with a single human hand by merely squeezing the clamping plates of the attaching member toward each other.

These and other features and advantages of the present invention will either be discussed or will become apparent upon consideration of the following detailed description of the preferred embodiments and appended claims taken together with the accompanying drawing, in which:

DESCRIPTION OF THE PREFERRED EMBODIMENT

Figure 1:
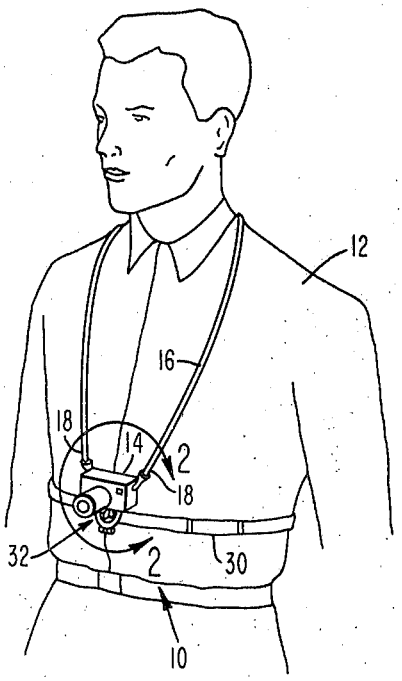
FIG. 1 is a perspective view of a harness in accordance with the present invention as worn upon a human torso to secure a photographic film camera thereto.

With reference to the drawing, FIG. 1 illustrates a preferred embodiment of a harness in accordance with the present invention generally referred to by the reference number 10. The harness 10 is depicted in FIG. 1 as it might be worn upon a human torso 12. There, the harness 10 is shown securing a photographic film camera 14 supported about the front surface of the upper portion of the human torso 12 by an elongated neckstrap 16. The neckstrap 16 has longitudinally opposite terminal ends 18 securely attached to the camera 14. To support the camera 14, the neckstrap 16 is guided along a path over the shoulders and about the rear surface of the neck of the human torso 12. Thus disposed, the neckstrap 16 supports the camera 14 between its terminal ends 18. While the preferred embodiment of the harness 10 of this invention is described as particularly adapted for securing photographic film camera 14, as will be apparent from this description, the harness 10 may be easily adapted to secure any other type of article, for example, binoculars, sound equipment and the like, supported relative to the human torso 12.

Figure 2:
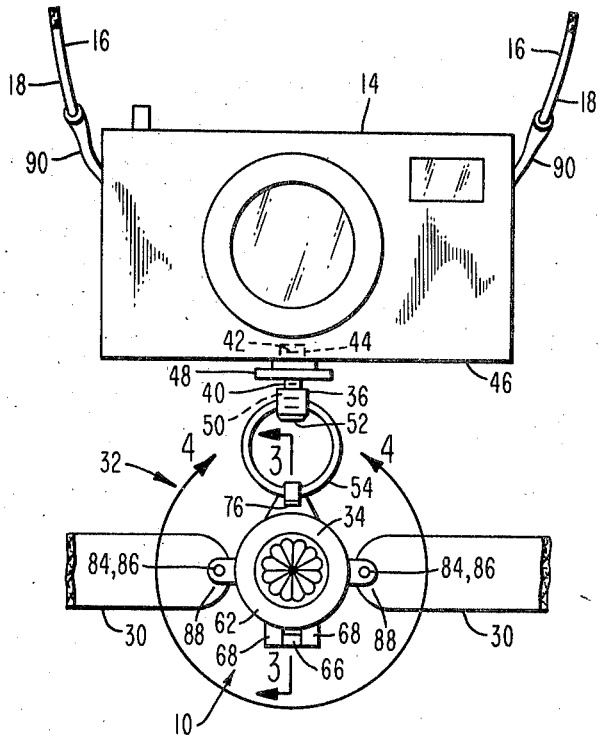
FIG. 2 is a plan view of one embodiment of a quick release fastening means of the harness taken along the line 2—2 of FIG. 1.

The harness 10 includes a quick release fastening means 32 for securing the camera 14 to a means for securing the quick release fastening means and camera in place relative to the torso 12. In the preferred embodiment, a belt 30 encircling the torso 12 of the user about the waist serves to so secure the quick release fastening means 32 and camera 14. As more clearly illustrated in FIG. 2, the quick release fastening means 32 includes an attaching member 34 and an attached member 36. While the illustration of FIG. 2 shows the attached member 36 secured to the camera 14 and the attaching member 34 secured to the circumtorso belt 30, it is clearly within the ambit of the present invention that the positions of the members 34 and 36 may be interchanged. In the preferred embodiment of the harness 10 illustrated in FIG. 2, the attached member 36 includes a stud 40 having a first end 42. The first end 42 is externally threaded to adapt the stud 40 to mate with an internally threaded connector receptacle 44 usually formed through a lower surface 46 into the body of common photographic film cameras, such as camera 14. The attached member 36 also includes a locking means 48 in the form of a disk-shaped locking nut threaded onto the stud 40 before its first end 42 is inserted into and mated with the connector receptacle 44. The locking means 48 may be employed to bind the stud 40 and the camera 14 together by screwing it along the stud 40 until it is brought into forceful contact with the lower surface 46 of the camera 14. This forceful contact with the lower surface 46 applies a longitudinal force to the stud 40 which establishes a frictional engagement between the meshing threads of the stud 40 and the connector receptacle 44 opposing their disengagement. The stud 40 further includes a cylindrically-shaped aperture 50 formed through a second end 52. The aperture 50, which is aligned essentially perpendicular to the longitudinal axis of the stud 40, retains a circumferentially split clamping ring 54, such as is frequently used for key rings. The split clamping ring 54 is threaded through the aperture 50 to provide a reliable, easily assembled structure which permits secure engagement of the attached member 36 with the attaching member 34.

Figure 3:
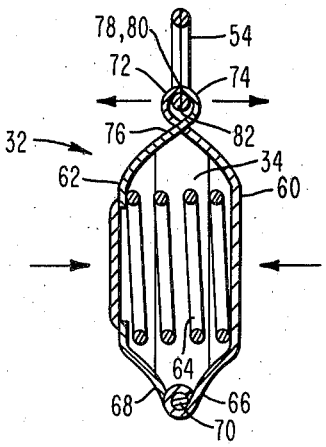
FIG. 3 is a cross-sectional view of the attaching member and clamping ring of the quick release fastening means taken along the line 3—3 of FIG. 2.
Figure 4:
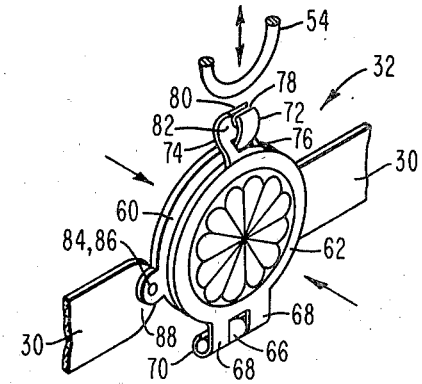
FIG. 4 is a perspective view of the clamping ring being inserted into or released from the attaching member taken along the line 4—4 of FIG. 2.

With reference to FIG. 3, the attaching member 34 includes a dish-shaped rear clamping plate 60 and an opposing dish-shaped front clamping plate 62. The clamping plates 60 and 62 are positioned in opposition to each other to retain a coil spring 64 between their respective concave facing side surfaces. The coil spring 64 is held under compression between the clamping plates 60 and 62 causing the spring 64 to apply a separating force urging the plates 60 and 62 away from each other. The clamping plates 60 and 62 are also pivotably secured to each other at a first location along adjacent edges thereof. Therefore, the plates 60 and 62 include mating hinge leaves respectively 66 and 68 projecting from their respective edges and are pivotably joined to each other by a hinge pin 70 secured between the leaves 66 and 68. The clamping plates 60 and 62 further include separable aperture forming elements 72 and 74, respectively, provided in the preferred embodiment by mating, intermeshing, C-shaped curve hooks. The curved hook, aperture forming elements 72 and 74 respectively project from adjacent edges of the clamping plates 60 and 62 at a location diametrically opposite to the hinge leaves 66 and 68. The curved hook, aperture forming element 74 of the front clamping plate 62 has formed therethrough a rectangularly-shaped aperture 76 through which passes the curved hook, aperture forming element 72 of the rear clamping plate 60. The aperture forming elements 72 and 74 are further formed so their respective free ends come together and contact along planar end surfaces respectively 78 and 80 when the plates 60 and 62 are in their furthest separated position responsive to the separating force applied by the coil spring 64. Thus, the curved hook, aperture forming elements 72 and 74 mate to form an openable, cylindrically-shaped aperture 82 aligned essentially parallel to the hinge pin 70 for enclosing the clamping ring 54 of the attached member 36. Thus constructed, the aperture forming elements 72 and 74, as illustrated in FIG. 4, are separable upon urging the clamping plates 60 and 62 together for passing the clamping ring 54 into or out of the aperture 82 to provide means whereby the members 34 and 36 may become securely engaged with each other or may be released from such engagement. As is readily apparent, the clamping plates 60 and 62 may be easily urged together for engaging or releasing the clamping ring 54 by merely squeezing them, for example, between the thumb and fingers of a single hand. Thus, it is seen that the aperture 82 of the attaching member 34 may be easily opened to engage or release the clamping ring 54 of the attached member 36. In addition to providing means for the engagement and disengagement of the attaching member 34 and the attached member 36, the hinge leaves 66 and 68 pivotably secured together by the hinge pin 70 and the mating planar end surfaces 78 and 80 of the aperture forming elements 72 and 74 also provide means for restraining the clamping plates 60 and 62 from moving further apart responsive to the separating force applied thereto by the compressed coil spring 64.

The attaching member 34 of the quick release fastening means 32, in addition to being adapted for securing the clamping ring 54 of the attached member 36, is also adapted for attachment to the circumtorso belt 30. For this reason the rear clamping plate 60 of the attaching member 34 further includes a pair of attaching lugs 84. The lugs 84 project outward from diametrically opposite sides of the edge of the clamping plate 60. The lugs 84 are located about the edge of the clamping plate 60 so the diameter thereof along whose projection they extend is aligned essentially perpendicular to a diameter line extending between the hinge leaf 66 and the curved hook, aperture forming element 72. The lugs 84 are respectively formed with an aperture 86 passing through them for securing the attaching member 34 between longitudinally opposite ends 88 of the circumtorso belt 30, as is best illustrated in FIG. 2.

Generally, items such as the camera 14 to be secured by the harness 10 are provided with a neckstrap 16. However, the harness 10 of the present invention also may be employed to secure other types of articles which are not initially equipped with a neckstrap or other equivalent means for suspending articles from the user's body. In such cases, the preferred embodiment of this invention further includes the elongated neckstrap 16 having clips 90 secured to its longitudinally opposite ends 18. The clips 90 serve to attach the neckstrap 16 securely to such an article. The neckstrap 16 is constructed with a length such that an article secured between its terminal ends 18 and located in front of and contacting the upper portion of the human torso 12 is supported above the torso's waist when the neckstrap 16 is guided along a path over the shoulders and about the rear surface of the neck of a user. The neckstrap 16 cooperates with the belt 30 and quick release fastening means 32 of the harness 10 to support an article securely in a location at which that article is easily and conveniently accessible to the user.

Figure 5:
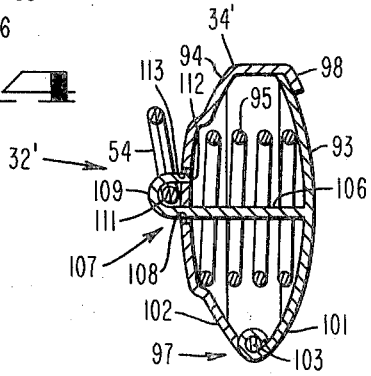
FIG. 5 is a cross-sectional view of another embodiment of a quick release fastening means for use in the harness of the present invention.

Another embodiment of a quick release fastening means 32' for use in the harness 10 of the present invention is illustrated in the FIG. 5. This embodiment of the quick release fastening means 32' includes an attached member like that described hereinbefore with reference to FIGS. 1–4, the split clamping ring 54 part thereof being shown in FIG. 5. The quick release fastening means 32' also includes an attaching member 34' comprising a pair of opposing dish-shaped clamping plates 93 and 94 that retain a coil spring 95 therebetween. The coil spring is held under compression between the clamping plates causing the spring 95 to apply a separating force urging the opposing plates 93 and 94 away from each other. The plates are restrained against separation by a hinge 97 at one side of the quick release fastening means 32' and a clasp 98 at an opposite side. The hinge 97 is formed of a pair of mating hinge leaves 101 and 102 respectively extending from adjacent edges of the opposing dish-shaped clamping plates 93 and 94 and pivotally joined together by a hinge pin 103. To engage the clamping ring 54 of the attached member and attaching member 34', the shank 106 of a hook 107 extends from the plate 93 coaxially with the coil spring 95 through an aperture 108 in the opposing plate 94, terminating at a curved end portion 109. The curved end portion 109 extends beyond the outside surface of the plate 94 a sufficient distance to define a space 111 adequate to enclose the clamping ring 54 when the opposing plates 93 and 94 are held in the normal furtherest separated position by the separating force of the retained coil spring 95. To ensure that the clamping ring 54 is captured securely by the hook 107, the loop formed by the curved end portion 109 is made of sufficient length so that the end 112 of the hook is recessed in an aperture 113 provided in the plate 94 when the plates 93 and 94 are in the normal furtherest separated position.

Thus constructed, the hook 107 and clamping ring 54 are engaged with each other or are released from such engagement by urging the opposing clamping plates 93 and 94 together against the spring force of the coil spring 95 to remove the end 112 of the hook 107 from the aperture 113 a sufficient distance to permit the clamping ring 54 to pass between the end 112 and the outside surface of the plate 94. As is readily apparent, the clamping plates 93 and 94 may be easily urged together for engaging or releasing the clamping ring 54 merely by squeezing them between the fingers of a single hand or by pressing them between the palm of a hand and torso of the user.

While the invention has been described in connection with preferred embodiments thereof, it will be apparent to those skilled in the art that various changes can be made without departing from the spirit of the invention. It is therefore intended that the coverage afforded applicant be limited only by the claims and their equivalent language.

I claim:

1. A harness for securing an article snuggly to a human torso, said article to be secured being separately supported from said torso, the harness comprising:

an elongated, circumtorso belt formed with two longitudinally opposed ends defining a length and adapted to be secured about said human torso; and a quick release fastener including a pair of engageable members comprising an attaching member and an attached member, said attaching member having a pair of elements pivotally secured together at a pivot for separation that permits selective engagement and disengagement with said attached member, said two longitudinally opposed ends of said circumtorso belt attached to said attaching member at spaced locations on opposite sides of the pivot along a line extending in the direction of the length of said belt midway between the pivot and a location on said attaching member opposite said pivot, said attached member adapted to be fastened to an article for securing said article to a human torso when said engageable members are engaged with said circumtorso belt secured about said human torso, the pair of pivotally secured elements of said attaching member of the quick release fastener pivotable with a single hand for engaging and disengaging said attached member.

2. The harness of claim 1 wherein:

said article to be secured includes a connector receptacle formed therein through a surface thereof;

said attached member includes a stud having a first end formed to mate with and engage said connector receptacle in said article for securing said stud to said article, said attached member includes a clamping ring fastened at a second end of said stud for engagement with said attaching member of said quick release fastener; and said pair of elements of said attaching member includes a pair of opposed clamping plates having a spring interposed therebetween to apply a separating force to said plates that urges said plates away from each other, said clamping plates pivotably secured to each other respectively at adjacent first locations at adjacent edges of said plates, said attaching member includes a pair of separable elements defining an aperture for enclosing the clamping ring, each of said elements secured respectively to a different one of said clamping plates, said elements separable upon urging said clamping plates together for passing said clamping ring of said attached member of the quick release fastener into and out of said aperture, said attaching member includes a restraining means at a second location of said clamping plates opposite said adjacent first locations for restraining separation of said plates.

3. The harness of claim 2 wherein:

said opposed clamping plates of said attaching member are pivotably secured to each other by a hinge formed by mating hinge leaves projecting from respective edges of said clamping plates and by a hinge pin secured between and pivotably joining said hinge leaves;

said pair of separable elements includes intermeshing curved hooks projecting from respective edges of said clamping plates at adjacent locations opposite said hinge to define the aperture for enclosing the clamping ring; and said restraining means defined by end surfaces of said curved hooks furthest from said edges of said clamping plates shaped to contact and mate with each other when said clamping plates are in their furthest separated position responsive to said separating force applied thereto by said spring to restrain said plates against further separation by said spring, said end surfaces of said curved hooks being separable upon urging said clamping plates together for passing said clamping ring of said attached member into or out of said aperture.

4. The harness of claim 3 wherein said connector receptacle of said article has threads formed therein, said first end of said stud of said attached member has threads formed thereon to mate with and engage said threads formed within said connector receptacle of said article to secure said stud to said article; and further comprising:

a locking nut having an aperture formed therethrough with threads formed therein for mating engagement of said locking nut with said threaded terminal end of said stud between said clamping ring and said connector receptacle, said locking nut threadingly advanceable along said stud to engage forcefully said surface of said article in which said connector receptacle is formed to apply a longitudinal force to said stud productive of binding friction forces between said mated threads of said stud and said connector receptacle.

5. The harness of claim 1 further comprising:

an elongated neckstrap adapted at its longitudinally opposite ends for attachment to said article for supporting said article separately from the quick release fastener, the neckstrap having a length to support an article attached between said ends thereof above the waist of the human torso for securance by the quick release fastener when said neckstrap is disposed over shoulders of and about the rear of the neck of the human torso.

6. A quick release fastener for releasably engaging an attached member fastened to an article and releasably securing said article to an elongated circumtorso belt encircling a human torso, comprising:

a pair of opposed clamping plates pivotally secured to each other at a pivot at adjacent first locations of adjacent edges of said plates;

a spring interposed between the opposed clamping plates to apply a separating force to said clamping plates that urges said clamping plates away from each other;

a restraining means joined to the clamping plates for restraining separation of said clamping plates;

a pair of separable elements defining an aperture for enclosing the attached member, one of said elements secured to one of the pair of opposed clamping plates and the other of said elements secured to the other of said pair of opposed clamping plates, said pair of elements secured to said clamping plates spaced from the pivot along a first line, said elements separable upon urging said clamping plates together against the separating force for passing the attached member into and out of the aperture; and a pair of connectors for securing the quick release fastener to opposed ends of the elongated circumtorso belt, the connectors respectively attached to the pair of pivotally secured opposed clamping plates at spaced locations at opposite edges of the quick release fastener midway between the pivot and opposite adjacent second locations of adjacent edges of the clamping plates along a second line perpendicular to the first line.

7. The quick release fastener of claim 6 wherein the pair of separable elements includes separable intermeshing curved hooks projecting from respective edges of the clamping plates at the adjacent second locations of said clamping plates, said intermeshing curved hooks forming the aperture for enclosing the attached member.

8. The quick release fastener of claim 6 wherein the pair of separable elements includes a hook and a wall portion of one of the opposed clamping plates defining a first passageway therethrough, said hook having opposite ends, one of said opposite ends secured to the other of said opposed clamping plates with the hook extending through a second passageway defined by said one of said opposed clamping plates, the other of said opposite ends of said hook defining a curved end portion extending into the first passageway a distance to form with the wall portion defining said first passage way the aperture for enclosing the attached member, said curved end portion withdrawn from the first passageway to permit passing the attached member into and out of the aperture upon urging the clamping plates together against the separating force.

* * * * *